United States Patent [19]

Davidson

[11] 4,307,066

[45] * Dec. 22, 1981

[54] EXTRACTION OF METALS FROM MIXTURES OF OXIDES OR SILICATES

[75] Inventor: Charles F. Davidson, Layton, Utah

[73] Assignee: The United States of America as represented by the Secretary of the Interior, Washington, D.C.

[ * ] Notice: The portion of the term of this patent subsequent to Aug. 25, 1998, has been disclaimed.

[21] Appl. No.: 116,695

[22] Filed: Jan. 30, 1980

[51] Int. Cl.[3] ..... C01D 15/04; C01F 11/28

[52] U.S. Cl. ..... 423/155; 423/1; 423/111; 423/131; 423/138; 423/150; 423/179.5; 423/208

[58] Field of Search ..... 75/111, 113, 114; 423/155, 179.5, 208, 1

[56] References Cited

U.S. PATENT DOCUMENTS

| | | | |
|---|---|---|---|
| 385,345 | 7/1888 | Faure | 75/113 |
| 846,657 | 3/1907 | Frolich | 75/113 |
| 1,013,498 | 1/1912 | Koehler | 75/113 |
| 1,247,619 | 11/1917 | Beckett | 423/499 |
| 1,384,465 | 7/1921 | Hey | 75/113 |
| 1,736,660 | 11/1929 | Mitchell | 75/113 |
| 1,870,478 | 8/1932 | Bacon et al. | 75/113 |
| 2,723,902 | 11/1955 | Reeve et al. | 75/111 |
| 2,843,472 | 7/1958 | Eberhardt | 75/113 |
| 2,893,828 | 7/1959 | Peterson | 423/179.5 |
| 3,909,249 | 9/1975 | Coldrey et al. | 75/113 |

*Primary Examiner*—O. R. Vertiz
*Assistant Examiner*—Wayne A. Langel
*Attorney, Agent, or Firm*—William S. Brown; Donald A. Gardiner

[57] ABSTRACT

Metals are extracted from mixtures of oxides or silicates by reacting the mixture at elevated temperature with a gaseous chlorinating agent comprising a mixture of water vapor and hydrogen chloride to selectively chlorinate the desired metal or metals.

7 Claims, No Drawings

EXTRACTION OF METALS FROM MIXTURES OF OXIDES OR SILICATES

Metallurgical methods using chlorination for extraction of metals from mixtures of oxides or silicates, particularly ores, are well known. The most commonly used chlorinating agent is gaseous chlorine, but HCl, $BCl_3$, $CCl_4$ and $COCl_2$ have also been used. Methods using these agents, however, have the disadvantages of high cost for the chlorinating agent, and nonselective chlorination of most metals. In addition, chlorine generally requires the use of a reducing agent, such as carbon, in admixture with the ore.

Chloride salts, such as $CaCl_2$, $FeCl_3$, KCl and NaCl, have also been used in chlorination roasting reactions, particularly for extraction of lithium from ores. However, such processes have the disadvantages of high temperature, long reaction times, nonselective chlorination and the necessity of mixing the chlorinating agent with the ore.

It has now been found, in accordance with the process of the invention, that efficient extraction of metals from mixtures of metallic oxides or silicates may be achieved by reaction of the mixture at elevated temperature with a chlorinating agent comprising a gaseous mixture of water vapor and hydrogen chloride, whereby compounds of the desired metal, or metals, are selectively chlorinated. The resulting soluble chlorides are then readily recovered by extraction with water.

The process of the invention has been found to be particularly useful for extraction of metals from ores, such as clays, which will generally contain metals predominantly in the form of oxides or silicates. Hence, the reaction with the gaseous $H_2O$-HCl mixture results in selective chlorination of oxides or silicates of metals such as alkali metals, alkaline earth metals, iron, aluminum, and other metals which form water soluble chlorides. The process of the invention has been found to be particularly effective for selective chlorination, and extraction, of alkali metals from ores, e.g., for extraction of lithium from clays. However, it may be used to selectively chlorinate any combination of the above-mentioned metal oxides or silicates. Examples of ores, other than clays, that may be treated according to the invention are doelomites, iron ores, spodumene, and lepidolite.

Chlorination of the alkali metal oxides or silicates with HCl follows the reactions:

$$M_2O+2HCl=2MCl+H_2O$$

$$M_2SiO_3+2HCl=2MCl+SiO_2+H_2O.$$

Thus, water concentrations above the equilibrium value will reverse the reactions and prevent chlorination. The $H_2O$/HCl ratio that exists at equilibrium depends on the temperature and pressure, and the specific oxide or silicate. Accordingly, selective chlorination of specific metal oxides or silicates depends on selection of optimum values of temperature, pressure, and HCl concentration in the $H_2O$-HCl gaseous mixture. Since these values may vary widely for selective chlorination of particular metal oxides or silicates, they are best determined experimentally. However, suitable temperatures will generally range from about 300° to 1200° C., preferably about 500° to 800° C., with corresponding pressures of about 0.1 to 10 atm, preferably about 0.5 to 1 atm. Optimum concentration of HCl in the mixture may also vary widely, e.g., about 5–90 percent by weight; however, a range of about 20 to 35 percent is generally preferred from the standpoint of both yield and economy.

The chlorination may be carried out in any conventional apparatus capable of providing the required temperature, pressure and gaseous atmosphere. The gaseous $H_2O$-HCl atmosphere is generally most conveniently provided by a flow of the gaseous mixture over or through the mixture of metal oxides or silicates for a time sufficient to effect substantial conversion of the desired metal or metals to soluble chlorides. Optimum flow rates of the $H_2O$-HCl mixture will also vary with the specific metal oxides or silicates, composition of the $H_2O$-HCl mixture and temperature and pressure, as well as the amount of oxide or silicate and the specific reaction vessel employed, but flow rates of about 5 to 50 cc/min/gram ore are generally satisfactory. Time required for the desired chlorination will also depend on the above-mentioned variables, but will generally be in the range of about 0.5 to 4 hours.

Although the chlorination reaction is generally most conveniently carried out in an atmosphere consisting essentially of the chlorinating agent of the invention, i.e., a mixture of water vapor and hydrogen chloride, the chlorinating ageny may be supplied by means of an inert carrier gas such as nitrogen. In such case, the sum of the partial pressures of the water vapor and the hydrogen chloride in the gaseous mixture will also be a factor in achieving the desired selective chlorination. Again, determination of the variable is best done experimentally.

Following chlorination, the resulting chlorides are readily leached from the reaction mixture with water, preferably at a temperature of about 20° to 80° C.

Although the extraction process of the invention will generally be used primarily for recovery of valuable constituents from raw materials, particularly ores, it may also be used for purification of materials by removal of undesirable constituents.

The process of the invention will be more specifically illustrated by the following examples:

EXAMPLES 1–6

A mixture of 10 grams each of finely ground $CaSiO_3$, $MgSiO_3$ and $Li_2SiO_3$ was chlorinated by means of gaseous $H_2O$-HCl at various temperatures, reaction times and HCl concentrations. Chlorination was done in a one-inch tube furnace fitted with a silica tube, with the $H_2O$-HCl mixture passing over the mixture of silicates at a flow rate of 50 cc/min. Reaction temperatures and time, and HCl concentration in the $H_2O$-HCl mixture, are given in Table 1.

After chlorination, the samples were water leached at 80° C. for 5 minutes and analyzed for the soluble chlorides. Results are given in Table 1. As is evident from the data in the table, highly selective and efficient chlorination, and resultant extraction, were possible with selection of suitable values of temperature and HCl concentration in the chlorination agent.

TABLE 1

| | TEMP | HCl | TIME | EXTRACTION (%) | | |
|---|---|---|---|---|---|---|
| NO. | (°C.) | (pct) | (min) | Mg | Ca | Li |
| 1 | 550 | 20 | 30 | .01 | 50 | 50 |
| 2 | 700 | 20 | 30 | .01 | 2 | 80 |
| 3 | 400 | 33 | 60 | .1 | 20 | 35 |
| 4 | 750 | 33 | 30 | .1 | 10 | 95 |

TABLE 1-continued

| NO. | TEMP (°C.) | HCl (pct) | TIME (min) | EXTRACTION (%) Mg | Ca | Li |
|---|---|---|---|---|---|---|
| 5 | 850 | 33 | 30 | .01 | 1 | 40 |
| 6 | 600 | 8 | 60 | .1 | 5 | 60 |

EXAMPLE 7

A mixture of 15 grams each of finely ground CaO and MgO was chlorinated with gaseous $H_2O$-HCl, containing 33 percent HCl, at 500° C. for 60 minutes. Chlorination, and subsequent leaching, were carried out by the procedure of Examples 1–6. Analysis of the leached sample showed 95 percent extraction of calcium, with only 0.01 percent extraction of magnesium. Thus, the process of the invention was also highly effective for selective extraction of oxides.

EXAMPLE 8

In this example, a clay containing 1.6% Al, 19.5% Si, 7.0% Mg, 12.7% Ca and 0.5% Li, was chlorinated at 700° C. with 20 percent HCl in the gaseous $H_2O$-HCl mixture. Again, chlorination and leaching were carried out by the procedures of the previous examples. Analysis of the leached sample showed 90 percent extraction of lithium, with only 10 percent extraction of calcium and 0.01 percent extraction of magnesium. Thus, the process of the invention was highly selective for extraction of lithium from clay.

I claim:

1. A process for extraction of lithium or calcium from a mixture of metal oxides or silicates, or oxides and silicates, consisting essentially of reacting the mixture with a chlorinating agent comprising a gaseous $H_2O$-HCl mixture at a temperature of about 300° to 1200° C. for a time sufficient to selectively convert a substantial proportion of one or both of said lithium and said calcium in the mixture to a water soluble chloride, and subsequently water leaching the metal chlorides from the mixture.

2. The process of claim 1 in which the mixture of metal oxides or silicates consists essentially of an ore.

3. The process of claim 2 in which the ore is a clay.

4. The process of claim 1 in which the reaction temperature is about 500° to 800° C.

5. The process of claim 1 in which the metal is lithium.

6. The process of claim 1 in which the metal is calcium.

7. The process of claim 1 in which the concentration of HCl in the chlorinating agent is about 20 to 35 percent by weight.

* * * * *